United States Patent [19]

Wilson

[11] 4,102,430

[45] Jul. 25, 1978

[54] PERIPHERAL RETURN FLOW MUFFLER

[75] Inventor: George T. Wilson, Oregon, Wis.

[73] Assignee: Tenneco, Inc., Racine, Wis.

[21] Appl. No.: 823,629

[22] Filed: Aug. 11, 1977

[51] Int. Cl.[2] ..... F01N 1/08

[52] U.S. Cl. ..... 181/265; 181/272

[58] Field of Search ..... 181/265, 272

[56] References Cited

U.S. PATENT DOCUMENTS

| | | | |
|---|---|---|---|
| 2,520,756 | 8/1950 | Bryant | 181/269 |
| 2,614,647 | 10/1952 | Bryant | 181/269 |
| 2,675,088 | 4/1954 | McLeod | 181/265 |
| 2,960,179 | 11/1960 | Bryant | 181/275 |
| 3,827,531 | 8/1974 | Hansen | 181/265 |

*Primary Examiner*—Donald G. Kelly

*Attorney, Agent, or Firm*—Harness, Dickey & Pierce

[57] ABSTRACT

A muffler for attenuating sound in internal combustion engine exhaust systems comprises an inner shell subdivided into an inlet chamber and an outlet chamber, inlet and outlet tubes for the muffler opening into the respective chambers, and an outer shell surrounding the inner shell but spaced transversely from it to provide a passage between the outer periphery of the inner shell and the inner periphery of the outer shell through which gas flows toward the inlet end of the muffler from the inlet chamber to the outlet chamber.

6 Claims, 2 Drawing Figures

PERIPHERAL RETURN FLOW MUFFLER

SUMMARY OF THE INVENTION

It is the purpose of this invention to provide a return flow or tri-flow type muffler structure for exhaust systems (or other pulsating gas flow systems) that is effective in reducing the sound level of the system from both the objective and subjective standpoints, produces an acceptable backpressure and horsepower loss, and is small enough to be packageable on the vehicle for which it is intended.

The invention achieves this purpose by utilizing the space between inner and outer shells as a return flow gas passage connecting inlet and outlet chambers that are formed within the inner shell and that communicate, respectively, with the open ends of inlet and outlet gas flow tubes.

Figure 1:
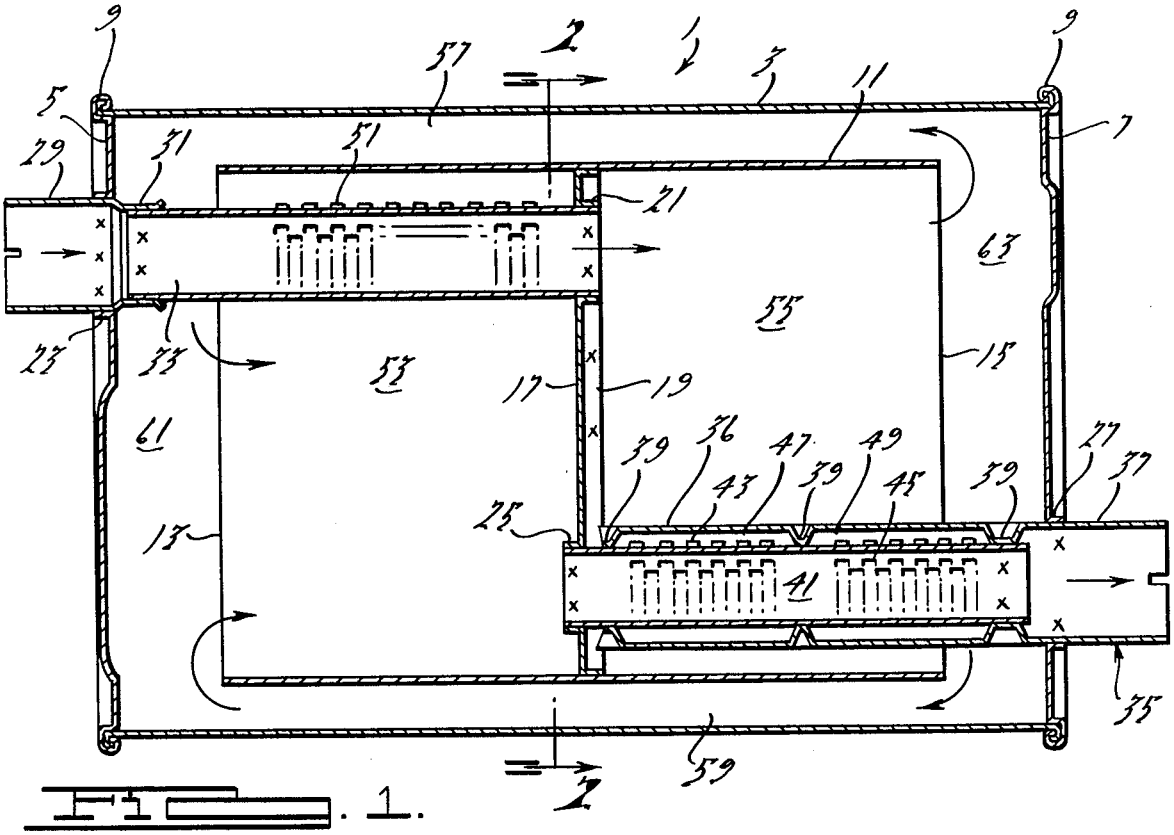
FIG. 1 is a longitudinal cross section through a muffler embodying the principles of the invention.

The "x's" in the drawings designate spotwelds.

DETAILED DESCRIPTION OF THE INVENTION

Figure 2:
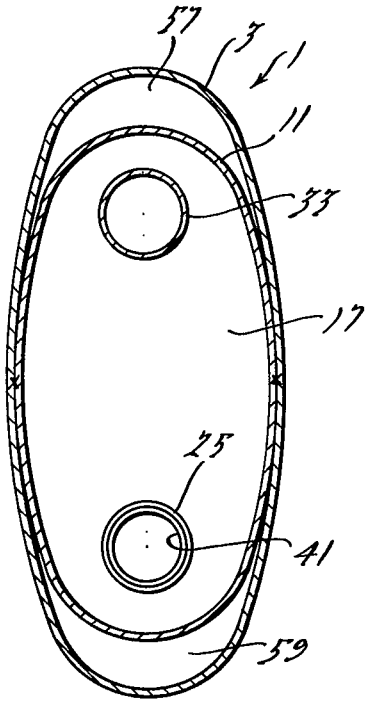
FIG. 2 is a cross section taken along the line 2—2 of FIG. 1.

The muffler 1 has an oval tubular outer shell 3 that is closed at its opposite ends by an inlet header 5 and an outlet header 7, the headers having outer edges that are interlocked with the ends of the shell in gas tight joints 9. An oval, open-ended inner tubular shell 11 is symmetrically positioned inside the outer shell and has an outer surface which is in contact with the inner surface of the outer shell, the contacting areas of the respective surfaces preferably being rather large as can be seen in FIG. 2. The two shells are preferably spotwelded to each other, as indicated at "*x*" in FIG. 2, along a midplane bisecting the major diameters of the shells 3 and 11. The open inlet and outlet ends 13 and 15, respectively, of the inner shell are spaced inwardly from the inlet and outlet headers 5 and 7. A transverse partition 17, located at substantially the logitudinal midpoint of shell 11, has a peripheral flange 19 that is spotwelded to the shell 11. The wall of partition 17 has a collar 21 formed in it which is coaxial with an inlet collar 23 formed in the inlet header 5 and also a collar 25 which is coaxial with an outlet collar 27 formed in the outlet header. Except for the collars, the partition 17 is preferably imperforate.

An inlet bushing 29 is mounted in and spot welded to the collar 23 and has a reduced diameter inner portion 31 which receives and is spotwelded to the outer end of an inlet tube member 33, the other end of the tube being supported in and spot welded to the partition collar 21.

An outlet tube member 35 comprises a tubular outlet shell 36 which has a bushing portion 37 mounted in and spotwelded to the collar 27 in header 7. The outer shell 36 has reduced diameter portions 39 which provide annular inner surfaces that engage and support a gas flow tube 41. The tube 41 has an inner end that fits within the collar 25 and is spotwelded to it and an outer end which opens into the bushing 37 and is spotwelded to the outermost of the reduced diameter portions 39.

In the embodiment illustrated, the outlet tube 41 has a pair of louver patches or sets of openings 43 and 45 which open, respectively, into closed annular chambers

47 and 49 that are formed between the tube 41 and the outer shell 36 and between the reduced diameter portions 39. The louver patches 43 and 45 with the chambers form high frequency attenuating spit chambers as is well known. In the embodiment shown, the inlet tube 33 also has a patch of louvers 51 extending over a major part of its length and opening into a chamber 53 formed on the inlet side of the partition 17. These louvers in combination with the fairly large chamber 53 serve to attenuate medium to high frequency sounds.

While the inlet tube is shown as perforated because of the louver patch 51, it is within the broad purview of this invention for it to be imperforate. Similarly, modifications can be made in the outlet tube member, such as the use of only a single tube, such as tube 41, either with or without perforations opening directly into chamber 55 that is between the partition 17 and the outlet header 7. Various combinations and arrangements of perforate and/or imperforate inlet and outlet tube members can be utilized within the broad framework of the invention.

The inner shell 11 has a smaller major diameter than the outer shell 3 and, therefore, is transversely spaced inwardly from it on each side to form longitudinal extending peripheral passages 57 and 59 running the full length of the inner shell 11. The ends of the inner shell are spaced from the inlet and outlet headers 5 and 7 to form, respectively, cross chambers 61 and 63 that connect the ends of the peripheral passages 57 and 59 with the chambers 53 and 55 inside of the shell 11.

In operation, gas enters the inlet bushing 29 and flows through the inlet tube 33 into the enlarged chamber 55 which may, therefore, be considered as an inlet chamber. Gas in the chamber 55 enters the crossover chamber 63 and reverses its direction of flow to enter peripheral passages 57 and 59 and return toward the inlet end of the muffler. As it leaves the passages 57 and 59, it enters the crossover chamber 61 and then flows to the enlarged chamber 53 which may be considered to be an outlet chamber. From there it flows into the outlet tube 41 and leaves the muffler through the outlet bushing 35. Some bypass flow through louvers 51 into the outlet chamber 53 can occur in the arrangement illustrated. Similarly, if the outlet tube member shell 36 were omitted some bypass flow could take place in the chamber 55 directly to the outlet tube.

In addition to the sound attenuation that occurs as a result of the louver patches 43, 45, and 51, there is attenuation due to the changes in cross sectional size of the passages through which the gas must flow. The inlet chamber 55 and the outlet chamber 53 act as relatively large volume compliance chambers. The chambers 61 and 63 will tend to function in combination with the adjacent chambers 55 and 53 as compliance volumes. The peripheral passages 57 and 59 are considerably smaller in cross section than the chambers and serve as inertance passages connecting the compliance volumes. Preferably, the longitudinal mid plane of the muffler 1, and therefore the midpoints of the peripheral inertance passages 57 and 59, is located substantially at a point of maximum compliance in the exhaust system for reasons set forth in U.S. Pat. No. 3,807,527 issued Apr. 3, 1974. When so located, the muffler 1 functions to attenuate sound in accordance with classic acoustic principles and also will tend to convert high energy exhaust pulses into lower energy pulses as described in U.S. Pat. No. 3,807,527.

Thus, the invention provides a relatively small and packageable muffler of the tri-flow or return flow type (return flow taking place through passages 57 and 59) that is effective in the objective and subjective attenuation of sound and in reducing the sound level of a pulsating gas system, and yet does not have restrictions or contours that produce an excessive back pressure or horsepower loss.

Modifications, some of which have been mentioned above, may be made in the specific structure shown without departing from the spirit and scope of the invention.

I claim:

1. A muffler for attenuating sound in pulsating gas flow systems, such as exhaust systems of internal combustion engines, comprising an outer tubular shell closed at opposite ends and having an inlet at one end and an outlet at the other end, a tubular inner shell positioned within the outer shell and open at each end, said inner shell being radially spaced inwardly from the outer shell to provide longitudinal gas passage means extending between the two shells for the full length of the inner shell and providing a gas flow passsage interconnecting opposite ends of inner shell, a transverse partition within the inner shell and subdividing it into an inlet chamber and an outlet chamber, an inlet tube connecting said inlet to the inlet chamber and extending through the outlet chamber, an outlet tube connecting the outlet to the outlet chamber and extending through the inlet chamber.

2. A muffler as set forth in claim 1 wherein said transverse partition is imperforate except for the passages accommodating said tubes.

3. A muffler as set forth in claim 1 wherein one of said tubes is perforated.

4. A muffler as set forth in claim 3 wherein said perforations open into one of said chambers.

5. A muffler as set forth in claim 1 wherein the opposite ends of said inner shell are spaced inwardly from the adjacent closed ends of the outer shell and define therewith crossover chambers extending across and full width of the outer shell and opening on one side into a chamber and on the other side into said passage means.

6. A muffler as set forth in claim 1 wherein said inner and outer shells are substantially coaxial and oval in cross section and in surface to surface contact along a portion of their major sides, the major diameter of the outer shell being substantially larger than the major diameter of the inner shell so that the minor sides of the two shells are transversely spaced from each other to provide a pair of longitudinally extending passages between the shells forming said longitudinal passage means.

* * * * *